US006500078B1

(12) United States Patent
Williams et al.

(10) Patent No.: US 6,500,078 B1
(45) Date of Patent: Dec. 31, 2002

(54) TRAINING DEVICE FOR BASEBALL PITCHERS

(76) Inventors: Eric A. Williams, 945 Tennis Ave., Maple Glen, PA (US) 19002; Mark F. Williams, 945 Tennis Ave., Maple Glen, PA (US) 19002

( * ) Notice: Subject to any disclaimer, the term of this patent is extended or adjusted under 35 U.S.C. 154(b) by 8 days.

(21) Appl. No.: 09/923,365

(22) Filed: Aug. 8, 2001

(51) Int. Cl.[7] ..... A63B 69/00; A63B 71/00; A63B 69/36; A63B 53/06

(52) U.S. Cl. ..... 473/452; 473/422; 473/497; 473/218; 473/270

(58) Field of Search ..... 473/218, 270, 473/271, 273, 422, 452, 497, 499, FOR 103; 482/142, 146

(56) References Cited

U.S. PATENT DOCUMENTS 3,244,421 A * 4/1966 Hanna ..... 434/252
4,666,155 A 5/1987 Stille
5,000,499 A 3/1991 Weeks
5,058,889 A 10/1991 Burton
5,188,357 A * 2/1993 Barnum ..... 473/497
5,385,343 A * 1/1995 Davis, Sr. ..... 473/452
6,102,818 A 8/2000 Hamilton
6,139,450 A 10/2000 Rivers
6,422,872 B1 * 7/2002 Outlaw ..... 434/247

* cited by examiner

*Primary Examiner*—Paul T. Sewell
*Assistant Examiner*—Mitra Aryanpour
(74) *Attorney, Agent, or Firm*—C. J. Husar, Esq.

(57) ABSTRACT

The disclosure relates to a baseball pitcher training device for training a pitcher in controlling his lower and upper body portions during the pitch preparation phase as well as the delivery and follow-through phase. The device comprises a portable balance beam and a simulated pitching "rubber" mounted thereon from which the pitcher initiates his pre-pitch movements. The balance beam provides a limited width foot landing area after pitch delivery to limit lower and upper body movement and ensure alignment with the plate to improve pitch accuracy. This embodiment is used primarily for pitch delivery from the stretch position. A second embodiment includes an enlarged mound platform area which is removably placed over the end of the balance beam/rubber area of the first embodiment to provide a more stable pitching area and is used for delivery from the full wind-up position. Both embodiments are lightweight and portable, useable indoors or on a practice field, and have been successfully used by either left or right-handed pitchers.

13 Claims, 3 Drawing Sheets

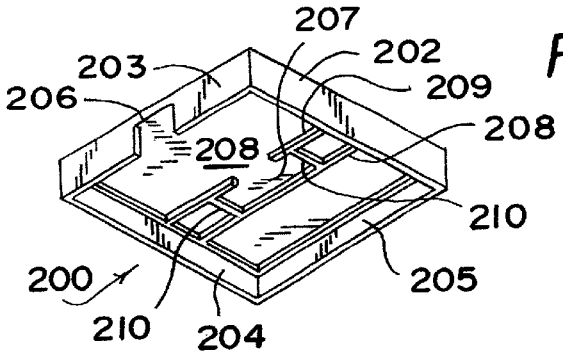
FIG. 5
FIG. 6
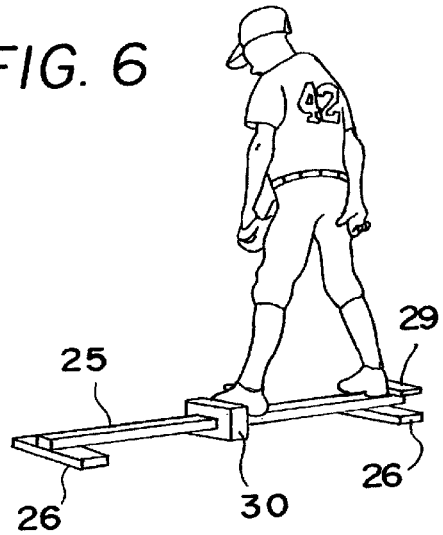
FIG. 7
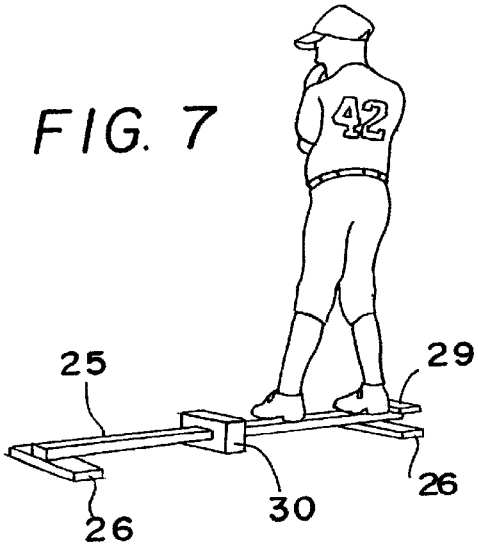
FIG. 8
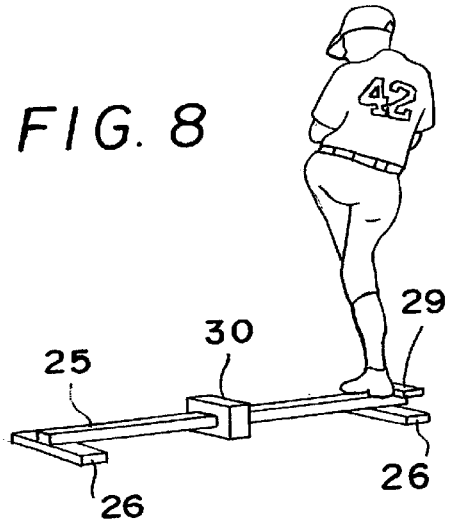
FIG. 9
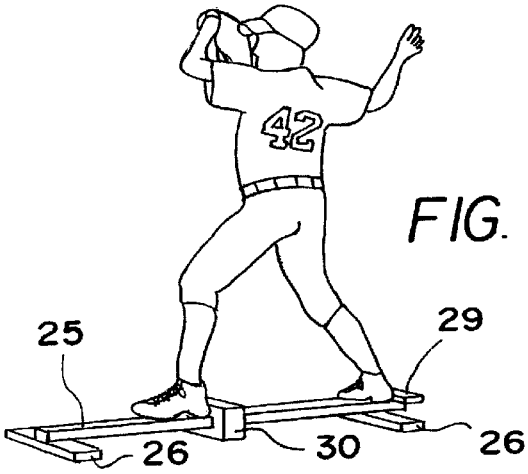
FIG. 10
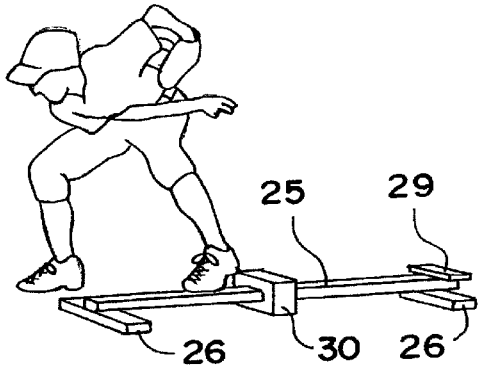

TRAINING DEVICE FOR BASEBALL PITCHERS

BACKGROUND OF THE INVENTION

The present invention relates generally to a training device for baseball pitchers. More specifically, it relates to a portable, lightweight training device which can be used with equal effectiveness by either left or right-handed pitchers and can be used indoors in a gymnasium or outdoors on a practice field.

It is well known that a significant number of our youth participate in the game of baseball. At very early ages players start with T-ball and progressively move through the ranks of organized baseball during their early teens. It is also a well known fact that good habits are very important to develop and instill in a player's routine. All positions on a baseball team require physical endurance and coordination. However, the position of pitcher requires specialized training above and beyond that which is required of all other positions. An effective pitcher plays a protective role in the outcome of a game while the remaining players play a reactive role. Therefore, the earlier a youngster is taught the proper mechanics of pitching, it will become second nature for him to step onto the mound and proceed in a manner that will utilize his practice and training in an effective manner.

A "healthy" body, proper pitching mechanics, confidence and self-control are necessary for successful baseball pitching. This invention is intended to help with the development of these physical and mental factors.

Baseball statistics have shown that a pitcher's first pitch is the most important pitch. It has been found that first pitches that are a strike, result in a significantly greater percentage of batter outs than when the first pitch is a ball. It has also been found that repetition in practice sessions where the pitcher properly repeats the body positioning and motions required for a striker, coupled with the watchful eye of a coach and his constructive criticism are the keys to successful pitching.

A pitching must utilize proper body mechanics in order to develop optimum pitch velocity, controlled placement and the intended spin. Pitch delivery mechanics are frequently described as pitching from the "full wind-up" position, or pitching from the "stretch" position. The "full wind-up" position is typically used when no runners are on base. Occasionally, this delivery is used when the bases are loaded or there is a runner on third base only.

Alternatively, the pitcher may use the "stretch" delivery when a runner is on third base, or the bases are loaded. With a runner on first and/or second base, the pitcher will certainly deliver from the "stretch" position, because this position enables the pitcher to pivot rapidly, facilitating a quicker throw to "pick-off" the base runner.

Increasingly, some relief pitchers favor delivery from the "stretch" position for most all situations, because it reduces the number of steps required to deliver the pitch. Fewer delivery steps reduces the risks of errors in body mechanics and conserves energy during the pitching process. This invention is intended to help develop proper body mechanics for both types of delivery, the "full wind-up" position (FIGS. 11–16) and the "stretch" position (FIGS. 6–10), as described hereinafter.

It is for the above stated reasons that applicants have designed the subject pitcher's training device to aid in the development of proper pitching mechanics, a "healthy" body and a confident mind.

DISCUSSION OF THE KNOWN PRIOR ART

A search of the pertinent subclasses in Class 473 and Class 482 revealed the following prior art:

U.S. Pat. No. 4,666,155—issued to Stilie on May 19, 1967, discloses an artificial pitching mound/pad per se. It is implanted or placed on a natural earth formed pitching mound and is comprised of a resilient friction pad which is received in a fiberglass base member and rim which conforms to the shape of the pad. Positioned on the upper surface of the resilient pad is a raised rear support surface accommodating the pitcher while standing prior to the delivery of a pitch. A ledge is formed in the contoured pitching surface for a pitching abutment block that is commonly referred to as the "pitching rubber". Between the base member and the pitching abutment block is a lower support surface which includes a pitching runway extending from the forward edge of the support surface to the end of the pad. Although this device has some similarities to the subject invention, it also has significant differences. The Stilie device does not include an adjustment feature for accommodating players of different leg length and most importantly, the "pitching runaway" is wider than the abutment block thus allowing the pitcher's body to turn and rotate excessively to the left or right thus resulting in a delivery which is "outside" of the plate producing a "ball" rather than a "strike".

U.S. Pat. No. 5,000,449—issued to Weeks on May 19, 1999, discloses a pitching trainer which includes a target area consisting of a net device. It further includes a mat having a simulative pitcher's "rubber" with marked regions for placement of a pitcher's feet thereover and a landing area for each foot separated by a divider. Additionally, a tee mechanism is mounted on a telescoping support extending from a base. The tee is designed to receive one ball at a time and is located with respect to the mat in such a manner that the pitcher, standing on the foot receiving portion of the mat will grasp a ball from the tee only when the pitcher's stance is appropriate for throwing the ball in the correct manner. The Weeks device includes many components which have nothing to do with the pitcher's delivery of the ball, except for the mat which includes a divider in the center thereof which forces the pitcher's feet to the left or right thereof thus ensuring that a twisting or rotating motion is imparted to the pitcher's upper body with a resulting pitch out of the strike zone for a ball.

U.S. Pat. No. 5,458,889—issued to Barton on Oct. 2, 1991, discloses a portable pitching mound and an attached home plate. The mound body includes a raised level portion which includes the pitching "rubber". A depression area includes soft soil-like material and the rubber and a landing area forward of the mound. The home plate is attached to the periphery of the mound by a calibrated line. Markings are provided on the periphery of the landing area permitting the user to check his stride length. Here again, there is nothing in this disclosure which will train a pitcher to land his foot in a specification area while keeping his upper body in a particular orientation to assure direct alignment with the catcher's mitt during delivery to the strike zone.

U.S. Pat. No. 6,102,818—issued to Hamilton on Aug. 15, 2000, discloses a stance and stride training device in FIGS. 5 & 6. The stance and stride mat is reversible and can be used for batting or throwing training. The mat includes stance stripes for positioning the user's feet and is used for training a thrower, there is no mention in this disclosure of training a pitcher.

U.S. Pat. No. 6,139,450—issued to Rivers on Oct. 3, 2000, discloses a multi-component device with adjustable components to aid in training a pitcher to success fully strike a target. The only similarity to applicant's device is the fact that they are both concerned with training a pitcher. The apparatus by which this is accomplished is completely different from applicants' device.

As can be seen from the above cited art, many attempts have bee made to provide a pitcher with the proper training to improve his pitching abilities. However, there still remains a need for a training device, which will train a pitcher for delivery from the "full wind-up" or "stretch" position wherein a specific location is required for the pitcher to land his foot during delivery without turning or rotating his upper or lower body excessively to the left or right of the intended target to enable a direct line of flight for the ball on its way to the catcher's mitt resulting in a perfect pitch. It is believed that the subject invention accomplishes this goal in a manner that will be described in greater detail hereinafter.

SUMMARY OF THE INVENTION

The subject invention provides a training device for a baseball pitcher which is lightweight, portable, easily erected and can be used indoors in a gymnasium or outdoors on a practice field. The device includes a pitcher's abutment block or "rubber" and an elongated balance beam for the pitcher's foot during delivery of a pitch. The elongated balance beam is of limited width which requires the user to maintain balance and ensures that the user's lower and upper body portions will not over or under rotate, remaining aligned with home plate during delivery, facilitating control of the ball in flight. A friction surface is provided to limit or minimize foot slippage and an adjustable stride gauge block to accommodate pitchers of different leg length and strides. The adjustable stride gauge block requires the user's foot to land on the balance beam forward of the stride gauge block thus ensuring that maximum stretch and leverage is imparted to the user's body during delivery.

Two embodiments are disclosed, one used for the "stretch" position, (FIGS. 6–10), where the initial standing area of the pitcher is of limited size and the other, (FIGS. 11–16), for the "full wind-up" position where the initial standing area is comprised of an enlarged mound platform area that fits over the smaller standing area of the first embodiment. The enlarged mound platform area includes an upper support surface with an abutment block or "rubber" mounted thereon and a friction surface adjacent thereto. In some cases it has been found that initial use of the first embodiment by a player can be somewhat intimidating, therefore, the enlarged mound platform area is utilized until the user has developed sufficient skill and confidence in its use. The enlarged mound platform area is then removed and the user continues without it. The subject device is useably by and equally effective with or without the enlarged mound platform area and by either left or right-handed pitchers. It has been found that the user of the subject invention sufficiently contributes to the accuracy and consistency with which a pitcher delivers a baseball to the strike zone.

OBJECTS OF THE INVENTION

An object of the invention is to provide a lightweight, portable pitcher training device.

Another object of the invention is to provide a training device which includes a pitcher standing area and an elongated balance beam.

A further object of the invention is to provide a training device with a landing area positioned and dimensioned to train the user in consistently achieving upper and lower body balance before and during delivery of a pitch.

Yet another object of the invention is to provide a training device that includes upper friction surfaces to limit or minimize slippage during use thereof.

A still further object of the invention is to provide a training device which includes an adjustable stride gauge block to govern the proper placement of the stride foot.

Another object of the invention is to provide a training device which includes two embodiments, one for the "stretch" position and one for the "full wind-up" position.

These and other objects of the invention will become more apparent hereinafter. The instant invention will now be described with particular reference to the accompanying drawings which form a part of the specification wherein like reference characters designate like or corresponding parts throughout the several views.

BRIEF DESCRIPTION OF THE DRAWINGS

FIG. 5 is a view of the underside of the enlarged mound platform area illustrating the recesses which allow mating with the structure of FIG. 1 and 2.

FIG. 6 illustrates the pitcher in his initial stance position when pitching from the "stretch" position.

FIG. 7 illustrates the pitcher in his set position when pitching from the "stretch" position.

FIG. 8 illustrates the primary balance position of the pitcher when pitching from the "stretch" position.

FIG. 9 illustrates the break and stride position of the pitcher, when pitching from the "stretch" position and commonly referred to as the secondary power position.

FIG. 10 illustrates the follow-through position of the pitcher when pitching from the "stretch" position.

DETAILED DESCRIPTION OF THE DRAWINGS

Figure 1:
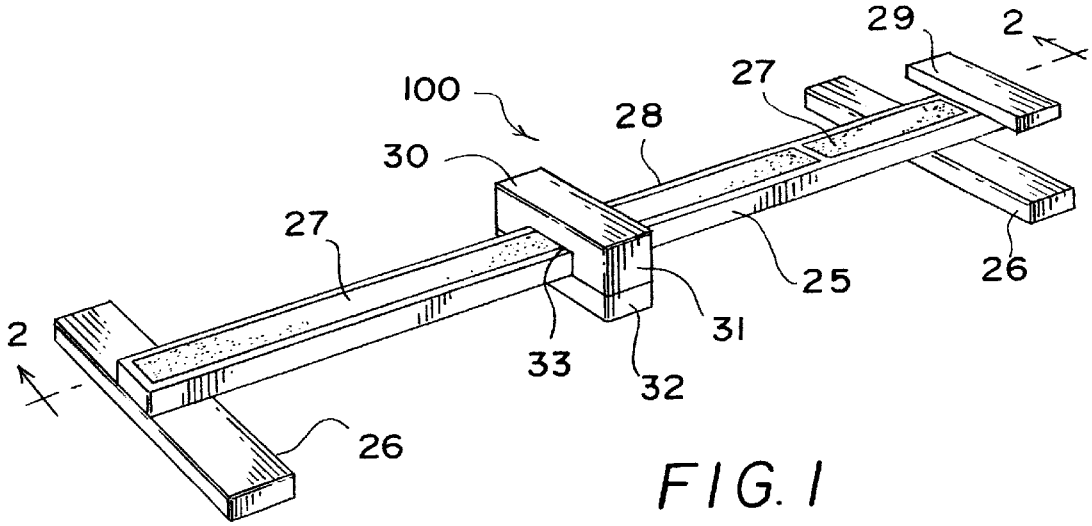
FIG. 1 is a perspective view of the first embodiment of the subject training device.

Referring now to FIG. 1, there is shown a perspective view of the first embodiment of the pitcher training device indicated by reference numeral 100. This is the embodiment which is used by a pitcher when pitching from the "stretch" position which has been described above. As shown, the training device 100 comprises an elongated balance beam 25 which is supported on opposites ends by a pair of support members 26. Balance beam 25 is permanently attached to support members 26 by screws (not shown) or other suitable attachment means to provide stability to the device when in use. A friction surface 27 is securely attached to the upper surface 28 of balance beam 25. Friction surface 27 covers substantially the entire upper surface of balance beam 25 and serves to provide the user with a slip resistant surface when in his initial stance position and when landing his foot thereon during delivery of the ball. Attached to upper surface 28 of balance beam 25, at the right end thereof, is an abutment block or "rubber" 29 which is used to locate or position the user's back foot during the various stages of the pitching procedure. An adjustable stride gauge block 30 is slidably mounted on balance beam 25. As shown, stride gauge block 30 includes an upper portion 31 which is notched at 33 to accommodate balance beam 25 and a lower portion 32 which secures the stride gauge block 30 thereon. Stride gauge block 30 is axially adjustable relative to balance beam 25 with friction surface 27 serving to hold it in place once adjusted for a particular user. The reason for the adjustability of stride gauge block 30 is to accommodate players of different leg length to increase their stride and leverage to a maximum during delivery. As can be seen from FIG. 1, balance beam 25 is of limited width. It has been found that a width of approximately four to six inches with an overall length of approximately four to six feet fulfills the needs of the device it that it provides the user with a restricted dimension for foot placement to properly control his balance and front foot placement which affects upper and lower body portions in delivering a pitch. The embodiment shown is constructed of wood, however, other materials such as plastic, aluminum, molded known composites, or combinations thereof may also be utilized.

Figure 2:
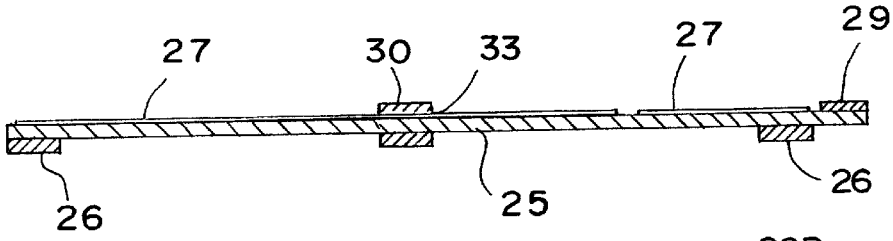
FIG. 2 is a sectional view of the device taken along the plane 2—2 of FIG. 1.

Referring to FIG. 2, there is shown a sectional view taken along the plane 2–2 of FIG. 1 illustrating the manner in which stride gauge block 30 surround balance beam 25 with friction surface 27 touching the upper surface of cut-out portion 33 of stride gauge block 30 to offer some resistance to its movement and permit stride gauge block 30 to be moved to a desired location and remain there until it is readjusted for a different user.

Figure 3:
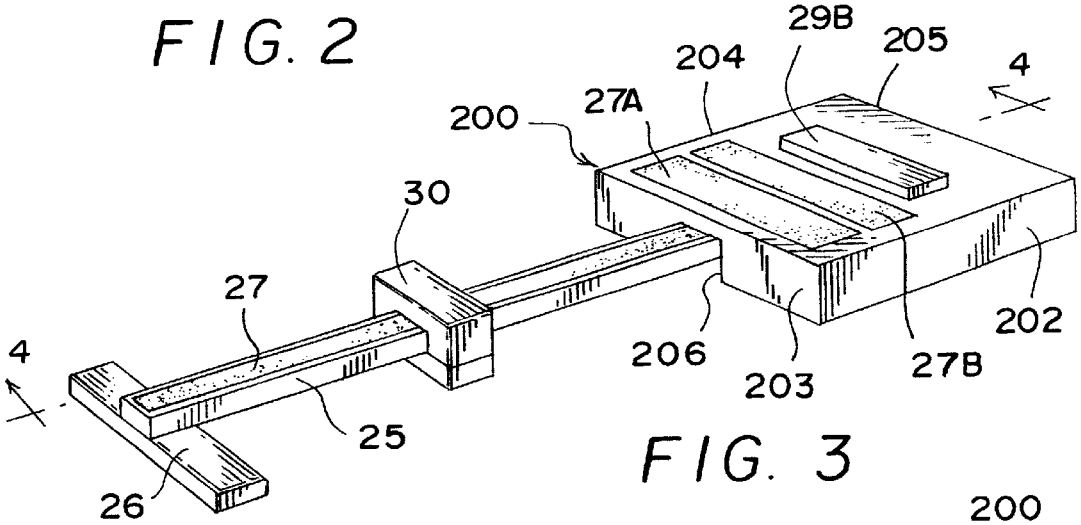
FIG. 3 is a perspective view of the second embodiment illustrating the enlarged mound platform area in place.

FIG. 3 is a perspective view of the second embodiment which incorporates an enlarged mound pitching platform area 200. This is the embodiment used when a pitcher is pitching from the "full wind-up" position. The term "full wind-up" and when it is utilized has been described above. Enlarged mound platform are 200 is shown placed over a portion of balance beam 25, right support member 26 and abutment block 29 and rests firmly on the ground. Enlarged mound platform area 200 has a flat upper surface 201, a pair of side walls 202, 204, a front wall 203 and a rear wall 205. Front wall 203 includes a cut-out portion 206 which straddles balance beam 25. Upper surface 201 provides a supporting surface for abutment block or "rubber" 29B. Additionally, friction strips 27A, 27B are mounted on upper surface 201 parallel to and spaced forward of abutment block 29B to minimize slipping when going through the various pitching phases.

Figure 4:
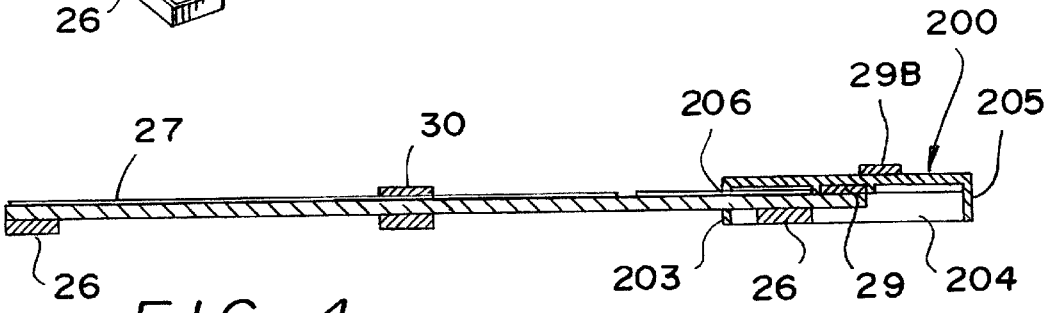
FIG. 4 is a sectional view of the second embodiment taken along the plane 4—4 of FIG. 3.

FIG. 4 is a sectional view taken along plane 4—4 of FIG. 3 illustrating how enlarged mound platform area 200 cooperates with the right-hand portion of balance beam 25 to provide a stable pitching platform.

Referring to FIG. 5 there is shown the underside of enlarged mound platform area 200. As illustrated, cut-out portion 206 is centrally located with respect to the width of enlarged mound platform area 200. Additionally, there is shown a recess 207 which receives abutment block 29 of the first embodiment device. Recess 207 is formed by a pair of spaced members 208 which extend the width thereof with a gap 209 in forward member 208 to receive balance beam 25. Gap 209 and cut-out portion 206 are of the same width for receiving balance beam 25. A pair of cross-brace members 210 extend between spaced members 208. As can be seen, the dimensions of recess 207 are sufficient to provide a snug fit for abutment block 29.

Referring now to FIGS. 6–10, there is illustrated a series of body movements that a right handed pitcher takes when pitching from the "stretch" position. FIG. 6 illustrates the pitcher in his initial stance "on the mound" balance beam 25 where he is comfortably positioned with his feet approximately twice shoulder width apart and his body weight balanced on the balance beam 25 with his right foot touching the side of abutment block 29 and his left foot abutting stride gauge block 30.

FIG. 7 illustrates the set position wherein the pitcher moves his left foot back along the balance beam 25 with his feet approximately shoulder width apart, prior to moving into the balance position.

FIG. 8 illustrates the balance position wherein the pitcher lifts the left foot and loads his body weight onto the rear leg in preparation of the break/stride.

FIG. 9 illustrates the break and stride phase (secondary power position), where the pitcher brings the left foot forward landing directly on the balance beam 25, in front of the adjustable stride gauge block 30.

FIG. 10 illustrates the follow-through position wherein the pitcher completes the delivery and brings his body through toward the batter.

Figure 11:
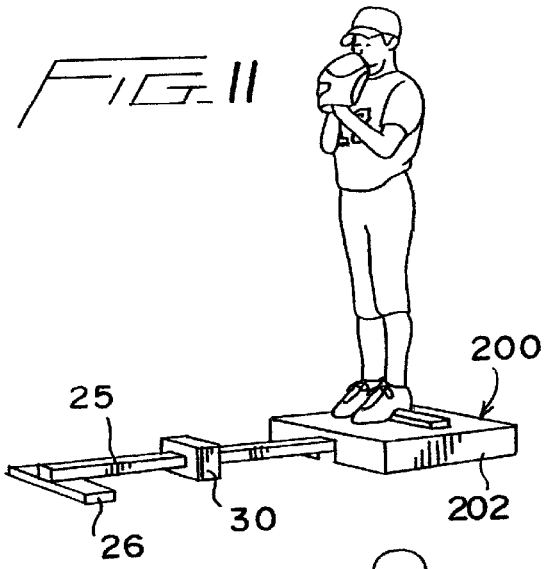
FIG. 11 illustrates the pitcher in his initial stance position when pitching from the "full wind-up" position.

Referring now to FIGS. 11–16, there is illustrated a series of body movements that a right handed pitcher undertakes when pitching from the "full wind-up" position. More specifically, FIG. 11 illustrates the pitcher in his initial stance on the mound, where he is comfortably positioned on the enlarged platform area 200, with his feet on the abutment block or "rubber" 29B.

Figure 12:
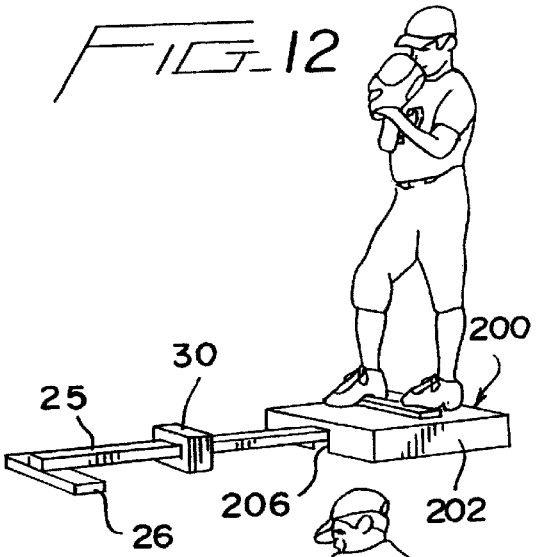
FIG. 12 illustrates the pitcher taking a short step back with his left foot when pitching from the "full wind-up" position.

FIG. 12 illustrates the pitcher on the enlarged mound area 200, taking a short step backward over the abutment block 29B with the left leg and foot. This step facilitates the rotation of the hips, right leg and foot.

Figure 13:
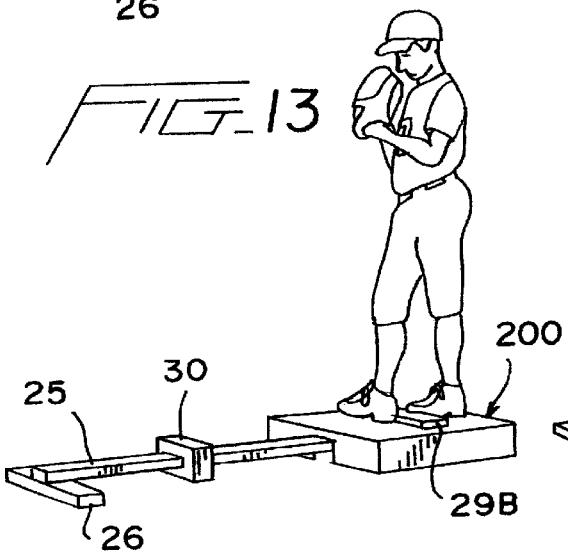
FIG. 13 illustrates the pitcher pivoting his body when pitching from the "full wind-up" position.

FIG. 13 illustrates the pitcher on the enlarged mound area 200, rotating the hips, right leg and placing his right foot against the abutment block or "rubber" 29B.

Figure 14:
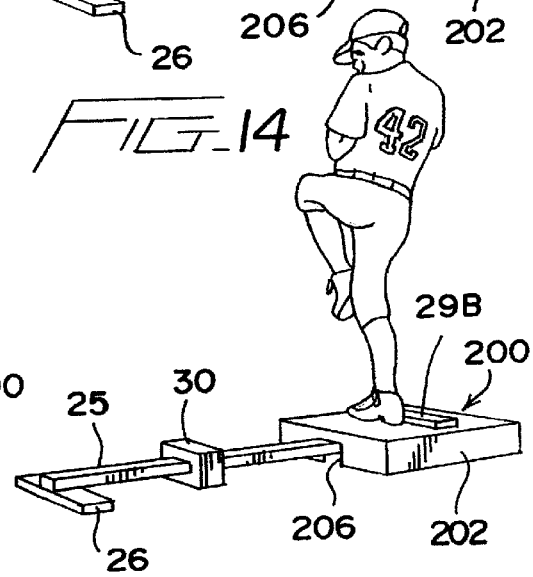
FIG. 14 illustrates the pitcher in his balance position when pitching from the "full wind-up" position.

FIG. 14 illustrates the pitcher on enlarged mound area 200, after this left leg has been rotated and is elevated into the balance position. The right leg carries all of the body weight and the right foot is tight against the abutment block 29B in preparation for pushing off of the "rubber" to propel the pitcher's lower and upper body in a forward direction towards the batter.

Figure 15:
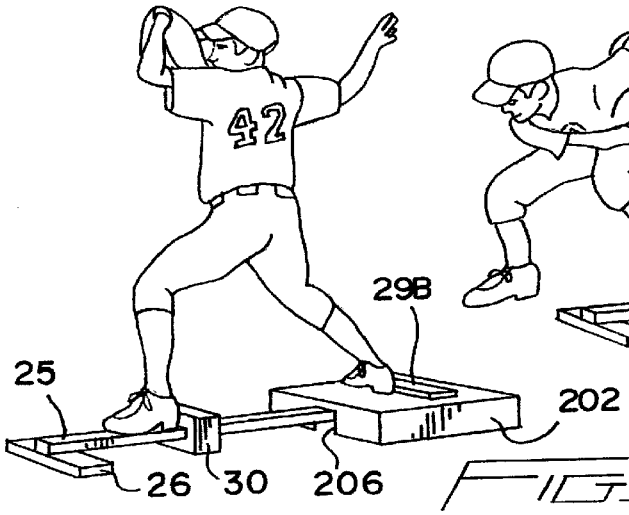
FIG. 15 illustrates the pitcher in his secondary power position when pitching from the "full wind-up" position.

FIG. 15 illustrates the pitcher in his secondary power position where his left leg is driven forward from the balance position and his left foot has landed directly on the balance beam 25, forward of the stride gauge block 30. If the left foot lands on either side of the balance beam 25, the lower portion of the body will be either "opened" or "closed" causing an "outside" or "inside" pitch to be thrown. The right foot remains on enlarged mound area 200, pushing against the abutment block or "rubber" 29B.

Figure 16:
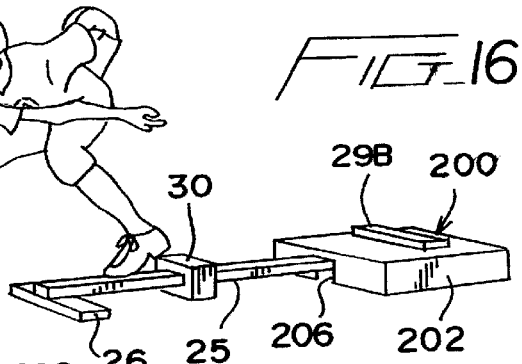
FIG. 16 illustrates the pitcher in his follow-through position when pitching from the "full wind-up" position.

FIG. 16 illustrates the pitcher in his follow-through position where his left foot remains on the balance beam 25, forward of stride gauge block 30. The pitcher's hips have rotated, bringing the right leg forward. The right foot lands adjacent to the training device, closely following the hip rotation, the upper portion of his body completes the pitching mechanics and follow-through as shown.

By way of review, it is pointed out that applicants have provided a pitcher training device which is useable by either left or right-handed pitchers pitching from either the stretch or full wind-up position. One of its main purposes is to train the user in maintaining proper balance, foot position in landing; alignment with home plate and also teaches the user to maximize his leg stride and body leverage when landing on the balance beam. Additionally, consistent use of the device provides the user with the confidence and body control necessary for a pitcher's sound mental state.

While the invention has been described in its preferred embodiments, it is to be understood that the words which have been used are words of description rather than words of limitation and that changes may be made within the purview of the appended claims without departing from the full scope or spirit of the invention.

Having thus described our invention, We claim:

1. A baseball pitcher training device for training a pitcher to maintain proper control of his upper and lower body portions prior to and during delivery of a baseball pitch, said training device comprising:

an elongated balance beam of limited width having an upper and lower surface;

support means attached to the lower surface of said balance beam at opposite ends thereof to provide stability to said balancing beam;

friction means on said upper surface of said balance beam covering substantially the entire surface;

a pitching rubber mounted on the upper surface of said balance beam adjacent to one end thereof; and foot locating means operably positioned on said balance beam whereby a pitcher positions his feet on said balance beam with one foot adjacent to said rubber and the other foot adjacent to said foot locating means in his initial stance position and proceeds through the various steps required to deliver a pitch with said other foot landing on said balance beam on the opposite side of said foot locating means without over or under rotating the upper and lower body portions of said user.

2. A baseball pitcher training device of the character defined in claim 1 wherein said elongated balance beam has a width of approximately four to six inches and an overall length of approximately four to six feet whereby said limited width requires the user to restrict his upper and lower body rotation thus ensuring a direct line of flight for a baseball during delivery.

3. A baseball pitcher training device of the character defined in claim 2 wherein said elongated balance beam and said related components are constructed of wood.

4. A baseball pitcher training device of the character defined in claim 2 wherein said elongated balance beam is constructed of lightweight aluminum.

5. A baseball pitcher training device of the character defined in claim 2 wherein said elongated balance beam is constructed of lightweight, high strength plastic.

6. A baseball pitcher training device of the character defined in claim 2 wherein said elongated balance beam is constructed from composite materials.

7. a baseball pitcher training device of the character defined in claim 2 wherein said elongated balance beam is constructed of a combination of the aforementioned materials.

8. A baseball pitcher training device of the character defined in claim 1 wherein said foot locating means is adjustable axially along the length of said balance beam to accommodate users of different leg length and said friction means serves to retain said foot locating means in a desired location once set for use by a pitcher of a particular leg length.

9. A baseball pitcher training device of the character defined in claim 1 wherein said friction means on said upper surface of said balance beam comprises a friction surfacing which covers substantially the entire upper surface of said balance beam and is attached thereto whereby a user will maintain slip resistant foot contact with said balance beam during use.

10. A baseball pitcher training device of the character defined in claim 1 wherein said training device is used to train a pitcher when pitching from the stretch position.

11. A baseball player training device of the character defined in claim 1 wherein said training device further includes an enlarged pitching platform means which is positioned over the portion of said elongated balance beam which includes said rubber whereby a pitcher develops body control for pitching from the full wind-up position.

12. A baseball pitcher training device of the character defined in claim 11 wherein said enlarged pitching platform comprises an upper surface supported by a front wall, rear wall and a pair of side walls;

said front wall including a notched portion therein for receiving said balance beam;

a recessed portion located on the underside of said upper surface for receiving said rubber therebeneath;

a second rubber mounted on said upper surface of said enlarged pitching platform and friction means positioned on said platform forward of said rubber to provide slip resistant foot contact with said platform during use.

13. A baseball pitcher training device of the character defined in claim 12 wherein said friction means comprises friction surfacing on the upper area of said pitching platform.

* * * * *